US010890099B2

(12) United States Patent
Bartalini

(10) Patent No.: US 10,890,099 B2
(45) Date of Patent: Jan. 12, 2021

(54) CLOSURE ELEMENT FOR CLOSING A HOUSING IN A HEAT-TRANSFER-FLUID PUMP CONTAINED IN AN ENGINE

(71) Applicant: Nissan Motor Co., Ltd., Yokohama (JP)

(72) Inventor: Michel Bartalini, Vieille Eglise en Yvelines (FR)

(73) Assignee: Nissan Motor Co., Ltd., Yokohama (JP)

( * ) Notice: Subject to any disclaimer, the term of this patent is extended or adjusted under 35 U.S.C. 154(b) by 33 days.

(21) Appl. No.: 16/313,188

(22) PCT Filed: Aug. 3, 2017

(86) PCT No.: PCT/FR2017/052184

§ 371 (c)(1),
(2) Date: Dec. 26, 2018

(87) PCT Pub. No.: WO2018/033670

PCT Pub. Date: Feb. 22, 2018

(65) Prior Publication Data

US 2020/0182126 A1 Jun. 11, 2020

(30) Foreign Application Priority Data

Aug. 16, 2016 (FR) ..... 16 57776

(51) Int. Cl.

| | |
|---|---|
| ***F01P 5/10*** | (2006.01) |
| ***F04D 29/44*** | (2006.01) |
| ***F01P 7/14*** | (2006.01) |
| ***F04D 29/58*** | (2006.01) |
| ***F01P 11/02*** | (2006.01) |

(52) U.S. Cl.

CPC ..... *F01P 5/10* (2013.01); *F01P 7/14* (2013.01); *F01P 11/0209* (2013.01); *F04D 29/445* (2013.01); *F04D 29/588* (2013.01); *F01P 2007/143* (2013.01)

(58) Field of Classification Search

CPC ..... F01P 5/10; F01P 7/14; F01P 2007/143; F01P 11/0209; F04D 29/445; F04D 29/588; F04D 29/44; F04D 29/441; F04D 29/442; F04D 29/444; F04D 29/447; F04D 29/448

See application file for complete search history.

(56) References Cited

U.S. PATENT DOCUMENTS

2011/0088638 A1* 4/2011 Yamagata ..... F01P 5/10 123/41.44
2016/0084259 A1* 3/2016 Chiba ..... F04D 29/086 415/112

FOREIGN PATENT DOCUMENTS

WO 2016/176712 A1 11/2016

* cited by examiner

*Primary Examiner* — Jacob M Amick
(74) *Attorney, Agent, or Firm* — Global IP Counselors, LLP

(57) ABSTRACT

A closure element is provided for closing a recess in a heat-transfer-fluid pump that is contained in an engine of a vehicle. In particular, in a cylinder block of the engine, the closure element including an element for guiding the flow of heat transfer fluid to an inlet of the pump.

9 Claims, 1 Drawing Sheet

Figure 1:
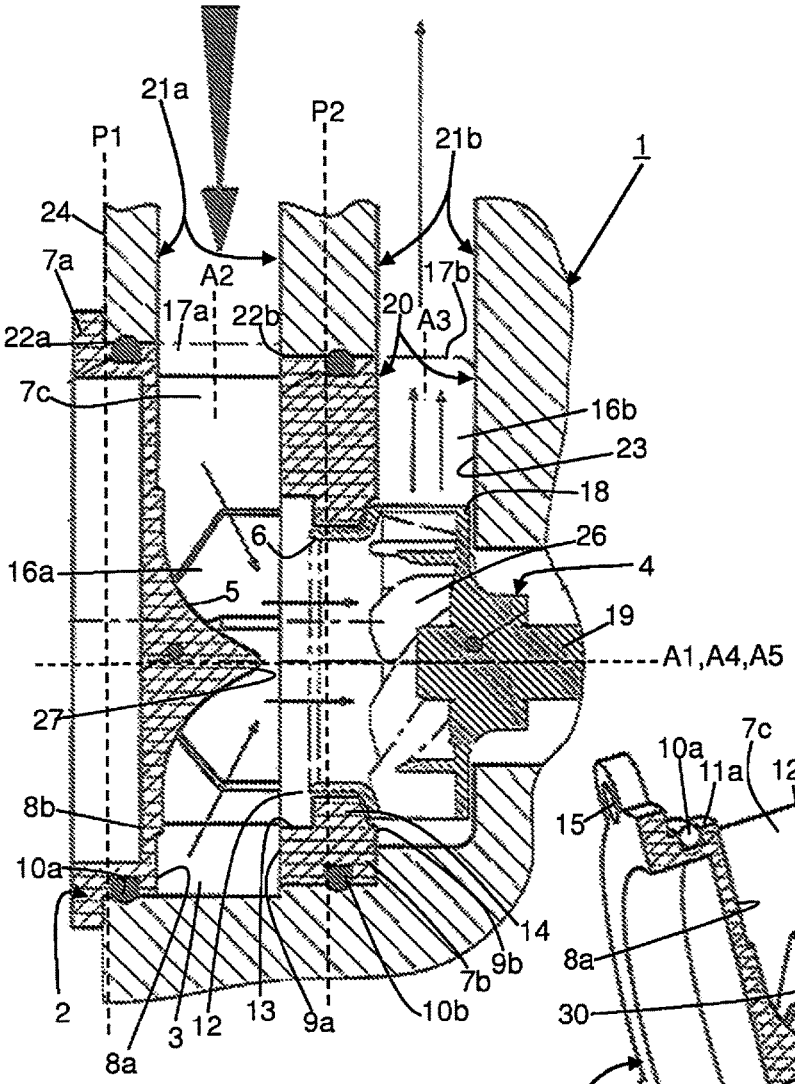

CLOSURE ELEMENT FOR CLOSING A HOUSING IN A HEAT-TRANSFER-FLUID PUMP CONTAINED IN AN ENGINE

CROSS-REFERENCE TO RELATED APPLICATIONS

This application is a U.S. national stage application of International Application No. PCT/FR2017/052184, filed on Aug. 3, 2017, which claims priority to French Patent Application No. 1657776, filed on Aug. 16, 2016.

BACKGROUND

Technical Field

The present invention relates to a closure element for closing a recess of a heat-transfer-fluid pump included in a heat engine of a vehicle, in particular in a cylinder block of the engine.

The invention also relates to a cylinder block including such a closure element as well as an engine including the cylinder block.

The invention also relates to a vehicle, in particular a motor vehicle, including such an engine.

Background Information

In the prior art, a heat engine typically comprises a cylinder block sealed by a cylinder head. For the proper operation of the engine, the blocks must be cooled. To that end, the engine includes a cooling circuit in which a heat transfer fluid is circulated using a pump and which, in turn, is cooled by extending through a radiator. Such a pump is traditionally arranged in an outer surface of the engine, in particular on a distribution wall also referred to as an accessory wall of the engine. The pump in particular includes a pulley, which drives a blade, or turbine, suitable for circulating the fluid in the cooling circuit. The pulley of the pump is driven by a transmission belt, which as a general rule drives other elements of the vehicle such as the alternator, the assisted steering pump, etc.

SUMMARY

It has been discovered that such an arrangement, however, has the drawback of being relatively bulky and complex to implement. It indeed causes them to be so bulky so as not to be suitable for the size of the engine compartment of modern vehicles, in particular in a context in which automobile builders and/or drivers are seeking, in light of the size of such compartments, to produce increasingly compact engines that nevertheless have improved performance in terms of power and/or efficiency, which often involves an increase in thermal loads in terms of the latter.

The present invention aims to overcome the drawbacks related to the prior art.

One aim of the invention is to reduce the size of the engine while making the cooling circuit more compact and easier to implement.

To that end, the invention relates to a closure element for sealing a recess of a heat-transfer-fluid pump included in a heat engine of a vehicle, in particular in a cylinder block of the engine, the closure element including an element for guiding the flow of heat transfer fluid to an inlet port of the pump.

In other embodiments:

- the closure element includes first and second parts connected together at first surfaces by a third part of the closure element;
- first and second parts of the closure element are respectively centered on median planes parallel together;
- first and second parts of the closure element each include at least one sealing element arranged on their peripheral wall;
- a second part of the closure element includes an opening defined to receive a part of the pump provided together with the inlet port of the heat transfer fluid;
- an opening of a second part of the closure element includes a wall comprising a guide area for part of the pump provided together with the inlet port of the heat transfer fluid;
- a first part of the closure element includes at least one attachment area for attaching the closure element to the cylinder block;
- the guiding element is defined on all or part of the first surface of a first part of the closure element, and
- the closure element is removable and/or in a single piece.

The invention also relates to a cylinder block including such a closure element.

In other embodiments:

- the closure element is mechanically connected to the cylinder block, in particular removably, and
- the closure element is arranged in the recess included in the cylinder block, so as to separate the recess into a low-pressure chamber and a high-pressure chamber.

The invention also relates to a heat engine including such a cylinder block.

The invention also relates to a vehicle, in particular a motor vehicle, including such a heat engine.

BRIEF DESCRIPTION OF THE EMBODIMENTS

Figure 2:
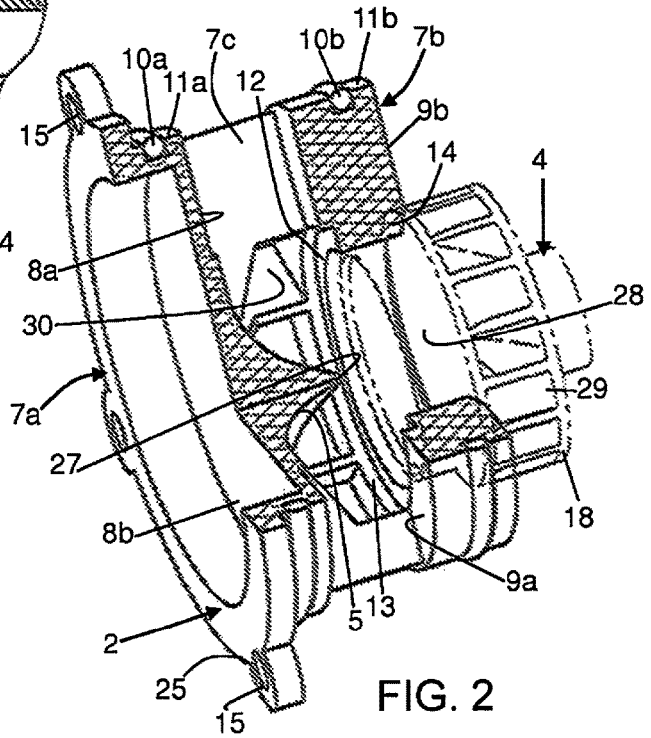

Other advantages and features of the invention will be better manifested upon reading the description that follows of one preferred embodiment, done in reference to the figures, provided as an indicative and non-limiting example:

FIG. 1 shows a partial sectional view of a cylinder block including a closure element arranged in a recess of a heat-transfer-fluid pump according to one embodiment of the invention, and FIG. 2 shows a sectional perspective view of the closure element according to the embodiment of the invention.

DETAILED DESCRIPTION OF THE EMBODIMENTS

In the following description, identical reference numbers denote identical parts or parts having similar functions.

FIG. 1 shows a part of a cylinder housing 1 of a heat engine of a vehicle, in particular a motor vehicle, commonly referred to as a "cylinder block", at the top of which a cylinder head is arranged. As is known, the cylinder block 1 comprises an inner circuit for circulating a heat transfer fluid, also referred to as coolant, which is for example intended to cool the engine while enabling the fluid to circulate around the cylinders of the engine. The inner circuit consists of at least one cooling chamber and includes an inlet that is connected via a discharge pipe 21*b* defined in whole or in part in the cylinder block 1, to a volute 20 outlet 17*b* of a heat-transfer-fluid pump 4. The pump 4 is capable of circulating the fluid in a coolant circuit of the engine.

The cylinder block 1 includes a recess 3 in which the pump 4 is arranged. The recess 3 includes an inlet 17*a* connected to a heat transfer fluid supply pipe 21*a* included in the cooling circuit. The supply pipe 21*a* is defined in whole or in part in the cylinder block 1. The inlet 17*a* and the outlet 17*b* of the recess 3 are included in inner walls 22*a*, 22*b* of the recess 3.

The inlet 17*a* and the outlet 17*b* of the recess 3 respectively include axes of symmetry A2 and A3 that are substantially perpendicular to an axis of symmetry A1 of the pump 4. The axis A1 is also an axis of symmetry of a rotary device 26 of the pump 4 suitable for circulating fluid in the cooling circuit and that may be a blade or a turbine. In another embodiment, the inlet 17*a* of the recess 3 may be defined in the first part 7*a* of the closure element 2 with an axis of symmetry A2 of the inlet 17*a* that is combined with the axis of symmetry A1 of the pump 4.

The cylinder block 1 includes a closure element 2 that is arranged in the recess 3 in order to sealingly and removably seal the recess 3. In FIGS. 1 and 2, such a closure element 2, which is preferably in one part, is a part attached to the cylinder block 1. The closure element 2 has a section having a circular shape. It includes first, second and third parts 7*a*, 7*b*, 7*c*. The first part 7*a* includes first and second surfaces 8*a*, 8*b*, and the second parts 7*a*, 7*b* includes first and second surfaces 9*a*, 9*b*. The first surfaces 8*a*, 9*a* of the first and second parts 7*a*, 7*b* of the closure element 2 are positioned in the latter across from one another. The first and second parts 7*a*, 7*b* are connected together at the first surfaces 8*a*, 9*a* by the third part 7*c*. The first and second parts 7*a*, 7*b* of the closure element 2 are respectively centered on median planes P1, P2 that are parallel to one another. The median planes P1, P2 are preferably perpendicular to the axis of symmetry A1 of the pump 4.

The third part 7*c* includes a plurality of ports 30 to allow the low-pressure heat transfer fluid to pass through the third part 7*c* and to the turbine 26 of the pump 4.

When the closure element 2 is arranged in the recess 3, the first and second parts 7*a*, 7*b* separate/compartmentalize the recess 3 into two chambers 16*a*, 16*b*: a low-pressure chamber 16*a* and a high-pressure chamber 16*b*. The low-pressure chamber 16*a* is included between the first and second surfaces 8*a*, 9*a* of the first and second parts 7*a*, 7*b*, and is defined in the continuation of the heat transfer fluid supply pipe 21*a*. The high-pressure chamber 16*b* in turn is included between the second surface 9*b* of the second part 7*b* and a bottom wall 23 of the recess 3 and is defined in the continuation of the heat transfer fluid discharge pipe 21*b*.

The first surface 8*a* of the first part 7*a* of the closure element 2 includes a guiding element 5 of the heat transfer fluid that circulates in the recess 3 coming from the supply pipe 21*a*. The second surface 8*b* of the first part 7*a* forms a cavity contributing to improving the gripping comfort of the closure element 2 in order to arrange it in the recess 3 and decrease the weight of the closure element 2. The second surface 8*b* also includes at least one attachment area 15 making it possible to mechanically connect the closure element 2 to an outer surface 24 of the cylinder block 1 by screwing, clipping or snapping. Each attachment area 15 is preferably included at an edge 25 defining a perimeter of the second surface 8*b*. Thus, the closure element 2 is attached removably to the cylinder block 1. Such a configuration makes it possible to facilitate access to the pump 4 in order to perform maintenance and/or assembly/disassembly operations of the latter.

The second part 7*b* of the closure element 2 includes an opening 12. The opening 12 is defined to receive a part of the pump 4 provided with an inlet port 6 for the heat transfer fluid. The part of the pump 4 includes a supply inlet area 28 for an enclosure 18 of the pump 4 in which the rotary device 26 is arranged. In particular, the opening 12 includes a wall 13 comprising a guiding area 14 of the inlet area 28 provided with the inlet port 6 for supplying the pump 4 with fluid. The inlet area 28 of the enclosure 18 has a circular section having a diameter adjusted to that defined by the guiding area 14 of the opening 12 in order to guarantee a reduced play to encourage the heat transfer fluid to pass through the inlet area 28, while allowing the rotary device 26 to rotate in the guiding area 14.

The enclosure 18 of the pump 4 is arranged in the high-pressure chamber 16*b* of the recess 3. It includes ports 29 through which the pressurized heat transfer fluid is discharged after it passes through the rotary device 26 of the pump 4. The pressurized heat transfer fluid is discharged into the part of the pressurized chamber 16*b* forming the volute of the pump 4, also referred to as the receiving chamber of the pump 4. The rotary device 26 is mounted on one end of a pump shaft 19 connected to a pump body (not shown).

The first and second parts 7*a*, 7*b* of the closure element 2 each include at least one sealing element 10*a*, 10*b*. These two parts 7*a*, 7*b* include peripheral walls 11*a*, 11*b* where the sealing elements 10*a*, 10*b* protrude. Indeed, the peripheral wall 11*a*, 11*b* of each first and second part 7*a*, 7*b* includes a slot in which the sealing element 10*a*, 10*b* is arranged. The sealing element 10*a*, 10*b* is preferably a sealing O-ring. When the sealing element 2 is arranged in the recess 3, the sealing elements 10*a*, 10*b* cooperate with the inner walls 22*a*, 22*b* of the recess 3 so as to provide a hermetic connection. Thus, the sealing elements 10*a*, 10*b* contribute to making the low-pressure and high-pressure chambers 16*a*, 16*b* tight in the recess 3. It will be noted that these inner walls 22*a*, 22*b* are defined in the recess 3 according to a stepping that is necessary for the assembly of the O-rings 10*a*, 10*b*.

In the sealing element 2, the guiding element 5 is defined over all or part of the first surface 8*a* so as to steer the heat transfer fluid toward the inlet port 6 of the pump 4 and therefore toward the axis of the rotary device 26. The guiding element 5 includes a protuberance on the first surface 8*a* of the first part 7*a* of the closure element 2. The protuberance preferably has an essentially pyramidal or conical shape. Under these conditions, the protuberance has an apex 27 that extends in a direction perpendicular to the median plane P1 of the first part 7*a*, toward the inlet port 6 of the pump 4 and therefore toward the axis of the rotary device 26. The guide element 5 includes an axis of symmetry A4 that passes through its apex 27 and that is combined with the axes of symmetry A1, A5 respectively of the pump 4 and the opening 12 of the second part 7*b* of the closure element 2.

Thus, when the closure element 2 is arranged in the recess 3, the heat transfer fluid circulates in the recess along the direction of the arrows shown in FIG. 1. More specifically, the heat transfer fluid coming from the supply pipe 21*a* penetrates the low-pressure chamber 16*a* toward the guide element 5 in a radial direction relative to the axes of symmetry A1, A4, A5 of the pump 4, of the guiding element 5 and the opening 12 of the second part 7*b*. The heat transfer fluid is next steered by the guiding element 5 toward the inlet port 6 of the pump 4 and therefore toward the axis of the rotary device 26 along an axial direction relative to the axes of symmetry A1, A4, A5. By penetrating the pump 4 and therefore the enclosure 18 including the rotary device 26, the fluid is compressed to be discharged under pressure into the pump volute 4 defined in a part of the high-pressure chamber 16*b* along a radial direction relative to the axes of symmetry A1, A4, A5 to next be conveyed in the inner circuit, which is for example intended to cool the engine while enabling the fluid to circulate around cylinders of the engine, via the discharge pipe 21*b*.

The invention claimed is:

1. A closure element for closing a recess of a heat-transfer-fluid pump included in a cylinder block of a heat engine of a vehicle, the closure element comprising:

an element for guiding a flow of heat transfer fluid toward an inlet port of the heat-transfer-fluid pump;

a first part having a first surface;

a second part having a second surface, the first surface of the first part being spaced from the second surface of the second part to define a first chamber therebetween; and a third part, the first part and the second part being connected together at the first and second surfaces by the third part, the element for guiding extending into the first chamber defined between the first surface of the first part and the second surface of the second part, and the element for guiding extending from the first surface of the first part toward the second surface of the second part.

2. The closure element according to claim 1, further comprising at least one of the first and second parts being centered on median planes that are parallel to one another, respectively, or the first and second parts including at least one sealing element arranged on peripheral walls of the first and second parts.

3. The closure element according to claim 1, further comprising the second part including a wall defining an opening that is configured to receive a part of the heat-transfer-fluid pump that has the inlet port for the heat transfer fluid, and the wall having a guide area for the part of the heat-transfer-fluid pump that has the inlet port for the heat transfer fluid.

4. The closure element according to claim 1, further comprising at least one of the first part including at least one attachment area for attaching the closure element to said cylinder block, or the first part including a first surface at least partially defining a guiding element.

5. The closure element according to claim 1, wherein the element is configured to be removable.

6. A cylinder block including the closure element according to claim 1.

7. The cylinder block according to claim 6, wherein the closure element is mechanically connected to the cylinder block with a detachable connection, and the closure element is arranged in a recess of the cylinder block, so as to separate the recess into the first chamber and a second chamber, the first chamber being a low-pressure chamber and the second chamber being a high-pressure chamber.

8. A heat engine including the cylinder block according to claim 6.

9. A motor vehicle including the heat engine according to claim 8.

* * * * *